US007329174B2

(12) United States Patent
Hosaka et al.

(10) Patent No.: US 7,329,174 B2
(45) Date of Patent: Feb. 12, 2008

(54) METHOD OF MANUFACTURING CHEMICAL MECHANICAL POLISHING PAD

(75) Inventors: Yukio Hosaka, Tokyo (JP); Hiroyuki Tano, Tokyo (JP); Hideki Nishimura, Tokyo (JP); Hiroshi Shiho, Tokyo (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 11/521,547

(22) Filed: Sep. 15, 2006

(65) Prior Publication Data

US 2007/0082587 A1 Apr. 12, 2007

Related U.S. Application Data

(63) Continuation-in-part of application No. 11/132,365, filed on May 19, 2005, now abandoned.

(30) Foreign Application Priority Data

May 20, 2004 (JP) ..... 2004-149884
Sep. 16, 2005 (JP) ..... 2005-270688

(51) Int. Cl.
*B24D 11/00* (2006.01)

(52) U.S. Cl. ..... 451/527; 451/526

(58) Field of Classification Search ..... 451/41, 451/285, 287, 288, 526, 527, 528, 529, 533, 451/539

See application file for complete search history.

(56) References Cited

U.S. PATENT DOCUMENTS 6,001,001 A * 12/1999 IslamRaja et al. ..... 451/41
6,089,966 A * 7/2000 Arai et al. ..... 451/533

(Continued)

FOREIGN PATENT DOCUMENTS

DE 102 11 342 A1 * 10/2002

(Continued)

*Primary Examiner*—Eileen P. Morgan
(74) *Attorney, Agent, or Firm*—Oblon, Spivak, McClelland, Maier & Neustadt, P.C.

(57) ABSTRACT

The present invention relates to a method of manufacturing a chemical mechanical polishing pad which provides a chemical mechanical polishing pad which fully suppresses the occurrence of a scratch on the polished surface and has an excellent polishing rate.

The method comprising either one of a group of steps (A) and a group of steps (B), the group of steps (A) including
(A1) the step of preparing a composition for forming a chemical mechanical polishing pad;
(A2) the step of molding the composition for forming a chemical mechanical polishing pad into a pad-like form;
(A3) the step of mounting the pad-like form on the round table of a cutting machine having at least a milling unit equipped with a milling cutter, a drive unit capable of angle indexing and positioning and a round table journaled by the drive unit;
(A4) the step of forming the second group of grooves with the milling cutter; and
(A5) the step of forming the first group of grooves, and the group of steps (B) including
(B1) the step of preparing a composition for forming a chemical mechanical polishing pad;
(B2) the step of molding the composition for forming a chemical mechanical polishing pad into a pad-like form having the second group of grooves by using a metal mold having projections corresponding to the shapes of the second group of grooves; and
(B3) the step of forming the first group of grooves.

4 Claims, 7 Drawing Sheets

U.S. PATENT DOCUMENTS

| | | | | |
|---|---|---|---|---|
| 6,120,366 | A * | 9/2000 | Lin et al. | |
| 6,220,942 | B1 * | 4/2001 | Tolles et al. | 451/65 |
| 6,692,338 | B1 * | 2/2004 | Kirchner | 451/41 |
| 6,749,714 | B1 * | 6/2004 | Ishikawa et al. | 156/345.12 |
| 6,783,436 | B1 * | 8/2004 | Muldowney | 451/41 |
| 6,824,455 | B2 * | 11/2004 | Osterheld et al. | 451/285 |
| 6,843,711 | B1 * | 1/2005 | Muldowney | 451/527 |
| 6,875,096 | B2 * | 4/2005 | Park et al. | 451/527 |
| 6,947,862 | B2 * | 9/2005 | Eaton et al. | 702/100 |
| 2001/0005667 | A1 * | 6/2001 | Tolles et al. | |
| 2004/0048552 | A1 * | 3/2004 | Kisbøll et al. | |
| 2005/0260929 | A1 * | 11/2005 | Shiho et al. | |
| 2006/0019587 | A1 * | 1/2006 | Deopura et al. | |

FOREIGN PATENT DOCUMENTS

| | | | |
|---|---|---|---|
| DE | 103 56 669 | A1 * | 6/2004 |
| EP | 0 919 336 | A2 * | 6/1999 |
| EP | 1 211 023 | A1 | 6/2002 |
| JP | 8-39423 | | 2/1996 |
| JP | 8-216029 | | 8/1996 |
| JP | 11-70463 | | 3/1999 |
| JP | 2002-11630 | | 1/2002 |
| JP | 2004-140130 | | 5/2004 |
| WO | WO 2006/089293 | A1 * | 8/2006 |

* cited by examiner (a)

(b)

sectional view along the line A-A (c)

sectional view along the line B-B (d)

sectional view along the line D-D

METHOD OF MANUFACTURING CHEMICAL MECHANICAL POLISHING PAD

FIELD OF THE INVENTION

The present invention relates to a method of manufacturing a chemical mechanical polishing pad which can be advantageously used in a chemical mechanical polishing process.

DESCRIPTION OF THE PRIOR ART

In the manufacture of a semiconductor device, chemical mechanical polishing (CMP) is attracting much attention as a polishing technique capable of forming an extremely flat surface. Chemical mechanical polishing is a technique for polishing by letting an aqueous dispersion for chemical mechanical polishing, for example, an aqueous dispersion of abrasive grains flow down over the surface of a chemical mechanical polishing pad while the polishing pad and the surface to be polished are brought into slide contact with each other. It is known that the polishing result is greatly affected by the performance characteristic and properties of the polishing pad in this chemical mechanical polishing.

Heretofore, chemical mechanical polishing has been carried out by using polyurethane foam containing pores as a polishing pad to hold slurry in holes (to be referred to as "pores" hereinafter) which are open to the surface of the resin. It is known that the polishing rate and the polishing result are improved by forming grooves in the surface (polishing surface) of the chemical mechanical polishing pad (JP-A 11-70463, JP-A 8-216029 and JP-A 8-39423) (the term "JP-A" as used herein means an "unexamined published Japanese patent application").

However, due to the improvement of the performance and the downsizing of a semiconductor device, the wiring pattern is becoming finer, the number of wiring layers is increasing and the performance required for chemical mechanical polishing and a chemical mechanical polishing pad is becoming higher. Although the design of a chemical mechanical polishing pad is described in detail in the above patent document, JP-A 11-70463, the polishing rate and the state of the polished surface are still unsatisfactory. There is a case where a surface defect like a scratch (to be referred to as "scratch" hereinafter) occurs, and the improvement of this defect is desired.

SUMMARY OF THE INVENTION

It is an object of the present invention which has solved the above problems of the prior art to provide a method of manufacturing a chemical mechanical polishing pad which fully suppresses the occurrence of a scratch on the polished surface and has an excellent polishing rate.

Other objects and advantages of the present invention will become apparent from the following description.

According to the present invention, firstly, the above objects and advantages of the present invention are attained by a method of manufacturing a chemical mechanical polishing pad (to be referred to as "the first method of the present invention" hereinafter) having a polishing surface, a non-polishing surface opposite to the polishing surface and a side surface for defining these surfaces, the polishing surface having at least two groups of grooves, the two groups of grooves consisting of (i) the first group of the first grooves which intersect an imaginary single straight line extending from the center portion toward the peripheral portion of the polishing surface and do not cross one another and (ii) the second group of the second grooves which extend from the center portion toward the peripheral portion of the polishing surface, intersect the first group of grooves and do not cross one another, the method comprising either one of (A) a group of steps and (B) a group of steps, the group of steps (A) including at least the following steps (A1) to (A5):

(A1) the step of preparing a composition for forming a chemical mechanical polishing pad;

(A2) the step of molding the composition for forming a chemical mechanical polishing pad into a pad-like form;

(A3) the step of mounting the pad-like form on the round table of a cutting machine having at least a milling unit equipped with a milling cutter, a drive unit capable of angle indexing and positioning and a round table journaled by the drive unit;

(A4) the step of forming the second group of grooves with the milling cutter; and (A5) the step of forming the first group of grooves, and the group of steps (B) including at least the following steps (B1) to (B3):

(B1) the step of preparing a composition for forming a chemical mechanical polishing pad;

(B2) the step of molding the composition for forming a chemical mechanical polishing pad into a pad-like form having the second group of grooves by using a metal mold having projections corresponding to the shapes of the second group of grooves; and (B3) the step of forming the first group of grooves.

According to the present invention, secondly, the above objects and advantages of the present invention are attained by a method of manufacturing a chemical mechanical polishing pad (may be referred to as "the second method of the present invention" hereinafter) having a polishing surface, a non-polishing surface opposite to the polishing surface, and a side surface defining these surfaces, the polishing surface having (i) a single first spiral groove which expands gradually from the center portion toward the peripheral portion of the polishing surface and (ii) a second group of grooves which extend from the center portion toward the peripheral portion of the polishing surface, intersect the above spiral groove and do not cross one anther, the method comprising either one of a group of steps (A) and a group of steps (B), the group of steps (A) including at least the following steps (A1) to (A5):

(A1) the step of preparing a composition for forming a chemical mechanical polishing pad;

(A2) the step of molding the composition for forming a chemical mechanical polishing pad into a pad-like form;

(A3) the step of mounting the pad-like form on the round table of a cutting machine having at least a milling unit equipped with a milling cutter, a drive unit capable of angle indexing and positioning and a round table journaled by the drive unit;

(A4) the step of forming the second group of grooves with the milling cutter; and (A5) the step of forming the first group of grooves, and the group of steps (B) including at least the following steps (B1) to (B3):

(B1) the step of preparing a composition for forming a chemical mechanical polishing pad;

(B2) the step of molding the composition for forming a chemical mechanical polishing pad into a pad-like form having the second group of grooves by using a metal mold having projections corresponding to the shapes of the second group of grooves; and (B3) the step of forming the first group of grooves.

DESCRIPTION OF REFERENCE NUMERICALS

Figure 1:
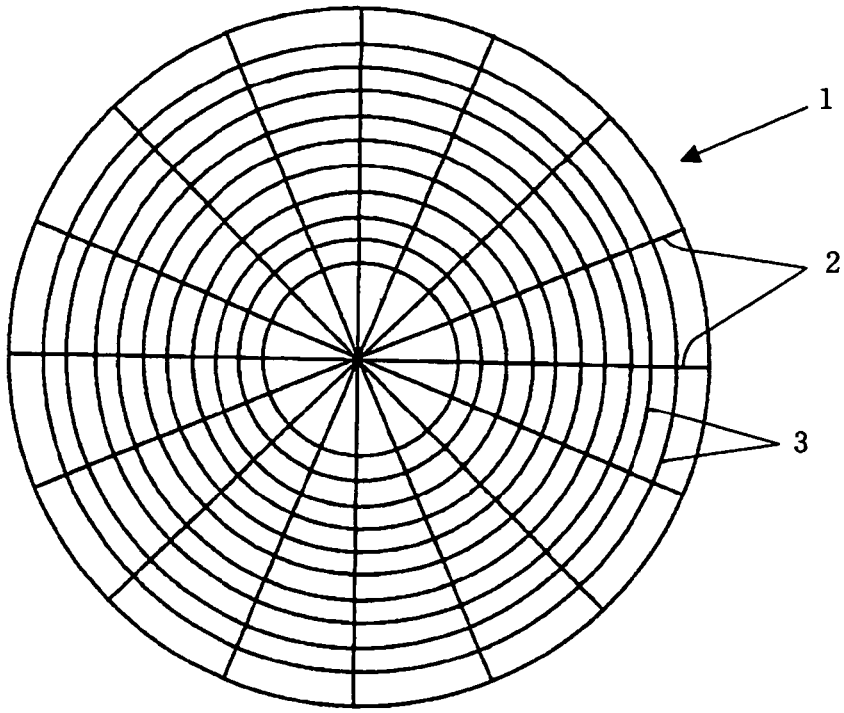
FIG. 1 is a diagram showing an example of the arrangement of grooves.

1 is a pad.

2, 2' and 2" are linear grooves.

3 is a concentrically circular groove.

4 is a spiral groove.

DETAILED DESCRIPTION OF THE PREFERRED EMBODIMENTS

The present invention will be described in detail hereinunder. A description is first given of the arrangement of grooves of a chemical mechanical polishing pad and a shape of the pad manufactured by the method of the present invention. A description is second given of the method of the present invention.

The first chemical mechanical polishing pad manufactured by the method of the present invention (to be referred to as "the first polishing pad" herein after) has a polishing surface, a non-polishing surface opposite to the polishing surface and a side surface for defining these surfaces, the polishing surface having at least two groups of grooves, the two groups of grooves consisting of (i) the first group of the first grooves which intersect an imaginary single straight line extending from the center portion toward the peripheral portion of the polishing surface and do not cross one another and (ii) the second group of the second grooves which extend from the center portion toward the peripheral portion of the polishing surface, intersect the first group of grooves and do not cross one another.

Although the grooves of the first group formed in the polishing surface are not limited to a particular shape, they may be, for example, two or more spiral grooves which expand gradually from the center portion toward the peripheral portion of the polishing surface, or annular or polygonal grooves which do not cross one another and are arranged concentrically. The annular grooves may be circular or elliptic, and the polygonal grooves may be tetragonal, hexagonal, and the like.

The grooves of the first group do not cross one another.

The grooves of the first group are formed in the polishing surface in such a manner that they intersect a imaginary single straight line extending from the center portion toward the peripheral portion of the polishing surface a plurality of times. For example, when the grooves are annular and the number of the annular grooves is 2, the number of intersections is 2, when the number of the annular grooves is 3, the number of intersections is 3, and when the number of the annular grooves is "n", the number of intersections is "n". When the grooves are two spiral grooves, supporsing that 360° is one turn, the number of intersections is 2 before the second turn, 3 after the start of the second turn, (2n−2) before the "n"-th turn and (2n−1) after the start of the "n"-th turn.

When the grooves are polygonal, the same can be said.

When the grooves are annular or polygonal, they are arranged not to cross one another and may be arranged concentrically or eccentrically but preferably concentrically. A polishing pad having the annular or polygonal first grooves which are arranged concentrically is superior in the above functions to other polishing pads. The annular grooves are preferably circular grooves, more preferably circular grooves which are arranged concentrically. When the circular grooves are arranged concentrically, the obtained polishing pad is excellent in the above functions and the formation of the grooves is easy.

The number of the grooves (annular grooves) which differ from one another in diameter and are arranged concentrically may be, for example, 20 to 400 and the number of the spiral grooves may be, for example, 2 to 10.

Although the size of the grooves is not particularly limited, the width of the grooves of the first group may be 0.1 mm or more, preferably 0.1 to 5 mm, more preferably 0.2 to 3 mm, particularly preferably 0.2 to 1.0 mm. The depth of the grooves may be 0.1 mm or more, preferably 0.1 to 2.5 mm, more preferably 0.2 to 2.0 mm, particularly preferably 0.5 to 1.5 mm. As for the interval between grooves, the shortest distance between adjacent intersections between the above virtual straight line and the grooves of the first group may be 0.05 mm or more, preferably 0.05 to 100 mm, more preferably 0.1 to 10 mm, particularly preferably 1.5 to 4 mm. A chemical mechanical polishing pad having the excellent effect of reducing the number of scratches on the polished surface and a long service life can be facilely manufactured by forming grooves having the above ranges.

The above preferred ranges may be combined in various ways. For example, the width of the grooves may be set to 0.1 mm or more, the depth of the grooves may be set to 0.1 mm or more, and the interval between adjacent grooves may be set to 0.05 mm or more. Preferably, the width of the grooves is set to 0.1 to 5 mm, the depth of the grooves is set to 0.1 to 2.5 mm, and the interval between adjacent grooves is set to 0.15 to 105 mm. More preferably, the width of the grooves is set to 0.2 to 3 mm, the depth of the grooves is set to 0.2 to 2.0 mm, and the interval between adjacent grooves is set to 0.6 to 13 mm.

Although the sectional form of the grooves, that is, the shape of the cut plane obtained when the grooves are cut in the normal direction is not particularly limited, it is, for example, polygonal or U-shaped. Examples of the polygonal shape include triangle, tetragon and pentagon.

The pitch which is the sum of the width of the grooves and the distance between adjacent grooves is preferably 0.15 mm or more, more preferably 0.15 to 105 mm, much more preferably 0.5 to 13 mm, particularly preferably 0.5 to 5.0 mm, ideally 0.5 to 2.2 mm.

The surface roughness (Ra) of the inner wall of each of the above grooves of the first group is preferably 20 μm or less, more preferably 0.05 to 15 μm, particularly preferably 0.05 to 10 μm. A scratch which may occur on the polished surface in the chemical mechanical polishing step can be prevented more effectively by setting this surface roughness to 20 μm or less.

The above surface roughness (Ra) is defined by the following equation (1):

$$Ra=\Sigma|Z-Z_{av}|/N \quad (1)$$

wherein N is the number of measurement points, Z is the height of a roughness profile and $Z_{av}$ is the average height of the roughness profile.

The above second group of the second grooves consists of a plurality of grooves extending from the center portion toward the peripheral portion of the polishing surface. The expression "center portion" as used herein means an area surrounded by a circle having a radius of 50 mm from the center of gravity on the surface of the chemical mechanical polishing pad as the center thereof. The second grooves of the second group may extend from any point within this "center portion" toward the peripheral portion and may be linear or arcuate, or a combination thereof.

The second grooves of the second group may or may not reach the peripheral end. Preferably, at least one of them reaches the peripheral end, that is, the side surface of the pad. For example, the second group of the second grooves may consist of a plurality of linear grooves extending from the center portion toward the peripheral portion and at least one of them may reach the side surface of the pad, or the second group of the second grooves may consist of a plurality of linear grooves extending from the center portion toward the peripheral portion and a plurality of linear grooves extending from a halfway portion between the center portion and the peripheral portion toward the peripheral portion and at least one of them may reach the side surface of the pad. Further, the second group of the second grooves may consist of pairs of two parallel linear grooves.

The number of the grooves of the second group is preferably 4 to 65, more preferably 4 to 64, more preferably 8 to 48, particularly preferably 16 to 32.

The grooves of the second group existent on the surface of the chemical mechanical polishing pad may or may not be in contact with the other second grooves but do not cross one another. Preferably, 2 to 32 out of the grooves of the second group are in contact with other grooves of the second group in the area of the above center portion. More preferably, 2 to 16 out of the grooves of the second group are in contact with other grooves of the second group. Further, preferably 2 to 33 grooves out of the grooves of the second group are not in contact with another groove of the second group in the area of the center portion, more preferably 2 to 32 grooves out of the grooves of the second group are not in contact with another groove of the second group in the area of the center portion, most preferably 6 to 32 grooves out of the grooves of the second group are not in contact with another groove of the second group in the area of the center portion. Some of the second grooves may be in contact with other grooves of the second group at positions other than the center portion of the surface of the pad.

Further, there are preferably 2 or more grooves, more preferably 2 to 7 grooves of the second group which extend from the center portion toward the peripheral portion and are not in contact with another groove of the second group in the area of the center portion between 2 adjacent grooves which are in contact with other grooves of the second group in the area of the center portion.

When all the grooves of the second group extend from the center portion toward the peripheral portion, the second group preferably consists of grooves not in contact with other grooves of the second group and grooves in contact with other grooves of the second group in the area of the center portion. Preferably, the grooves not in contact with other grooves of the second group in the area of the center portion start from positions 10 to 50 mm away from the center of the pad and extend toward the peripheral portion. More preferably, the grooves start from positions 20 to 50 mm away from the center of the pad and extend toward the peripheral portion.

On the other hand, when the second group consists of a plurality of linear grooves extending from the center portion toward the peripheral portion and a plurality of linear grooves extending from a halfway portion between the center portion and the peripheral portion toward the peripheral portion, the grooves starting from a halfway portion between the center portion and the peripheral portion preferably start from points on virtual lines connecting the center and the periphery of the pad, whose distances from the center are 20 to 80%, preferably 40 to 60% of the total distance from the center to the periphery of the pad. Even in this case, the plurality of linear grooves extending from the center portion toward the peripheral portion preferably consist of grooves not in contact with other grooves of the second group and grooves in contact with other grooves of the second group in the area of the center portion.

The preferred width and depth of the grooves of the second group are the same as those of the first group. The preferred range of the surface roughness (Ra) of the inner wall of each of the grooves of the second group is the same as that of the first group.

The grooves of the second group are preferably arranged as equally as possible on the surface of the chemical mechanical polishing pad.

The second polishing pad manufactured by the method of the present invention has a single first spiral groove which expands gradually from the center portion toward the peripheral portion of the polishing surface in place of the first group of grooves of the above first polishing pad.

The number of turns of the first spiral groove may be 20 to 400. 360° corresponds to one turn.

The first spiral groove has a width of 0.1 mm or more and a depth of 0.1 mm or more and the shortest distance between intersections between the first spiral groove and a single virtual straight line extending from the center portion toward the peripheral portion of the polishing surface may be 0.05 mm or more.

As for what is not described of the second polishing pad, it should be understood that what has been described of the first polishing pad can be applied to the second polishing pad as it is or with modifications obvious to those skilled in the art.

The shape of the chemical mechanical polishing pad manufactured by the method of the present invention is not particularly limited. It may be shaped like a disk or polygonal pole. The shape of the chemical mechanical polishing pad manufactured by the method of the present invention may be suitably selected according to a polishing machine to be used with the chemical mechanical polishing pad of the present invention.

For example, when the chemical mechanical polishing pad is shaped like a disk, its circular top surface and circular under surface serve as the polishing surface and the non-polishing surface, respectively.

The size of the chemical mechanical polishing pad is not particularly limited. For example, a disk-like chemical mechanical polishing pad has a diameter of 150 to 1,200 mm, particularly preferably 500 to 800 mm and a thickness of 0.5 to 5.0 mm, preferably 1.0 to 3.0 mm, particularly preferably 1.5 to 3.0 mm.

Examples of the arrangement of the grooves of the chemical mechanical polishing pad of the present invention will be described with reference to the accompanying drawings.

In FIGS. 1 to 10, the number of the grooves of the first group is 10 and the number of turns is about 10. These figures are schematic and it should be understood that the number of the grooves of the first group and the number of turns are preferably those calculated from the diameter of the polishing surface of the pad and the above pitch. FIGS. 1 to 10 show a disk-like pad and the same shall apply to the pads of other shapes.

In FIG. 1, the pad 1 has a second group of 16 linear grooves 2 extending from the center of the pad to the peripheral portion and a first group of 10 concentrically circular grooves 3 which differ from one another in diameter on the polishing surface. The 16 linear grooves 2 of the second group contact each other at the center but do not cross one another and the 10 concentrically circular grooves 3 of the first group do not cross one another but intersect the linear grooves. In the pad of FIG. 1, all the 16 linear grooves reach the side surface of the pad.

Figure 2:
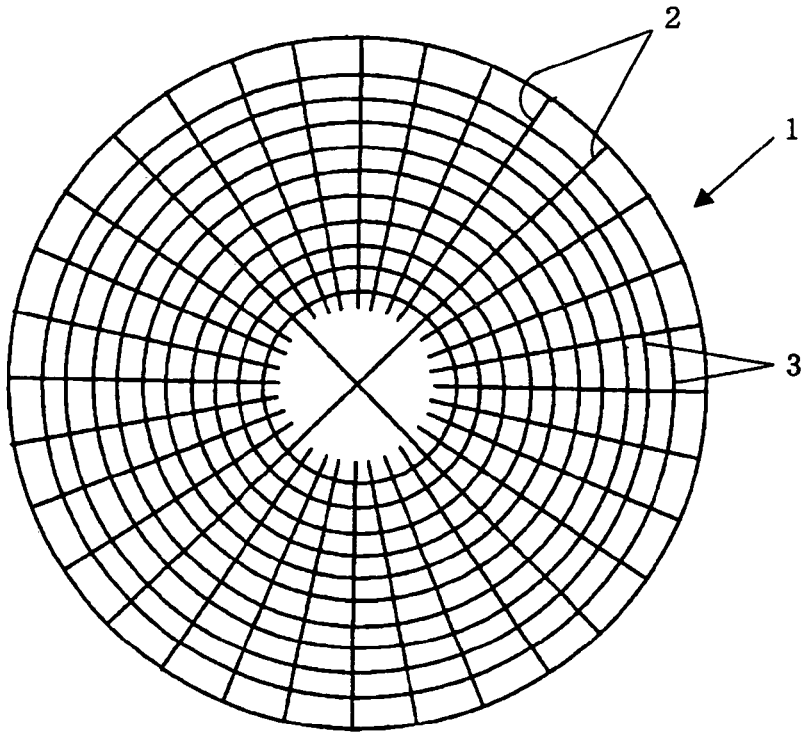
FIG. 2 is a diagram showing another example of the arrangement of grooves.

The pad of FIG. 2 has a second group of 32 linear grooves 2 and a first group of 10 concentrically circular grooves 3 which differ from one another in diameter. 4 out of the 32 linear grooves start from the center whereas the other 28 linear grooves start from a portion slightly away from the center (this portion can be judged as the center portion from the fact that the linear grooves intersect the smallest circular groove of the first group) toward the peripheral portion. In the pad of FIG. 2, all the 32 linear grooves reach the side surface of the pad.

Figure 3:
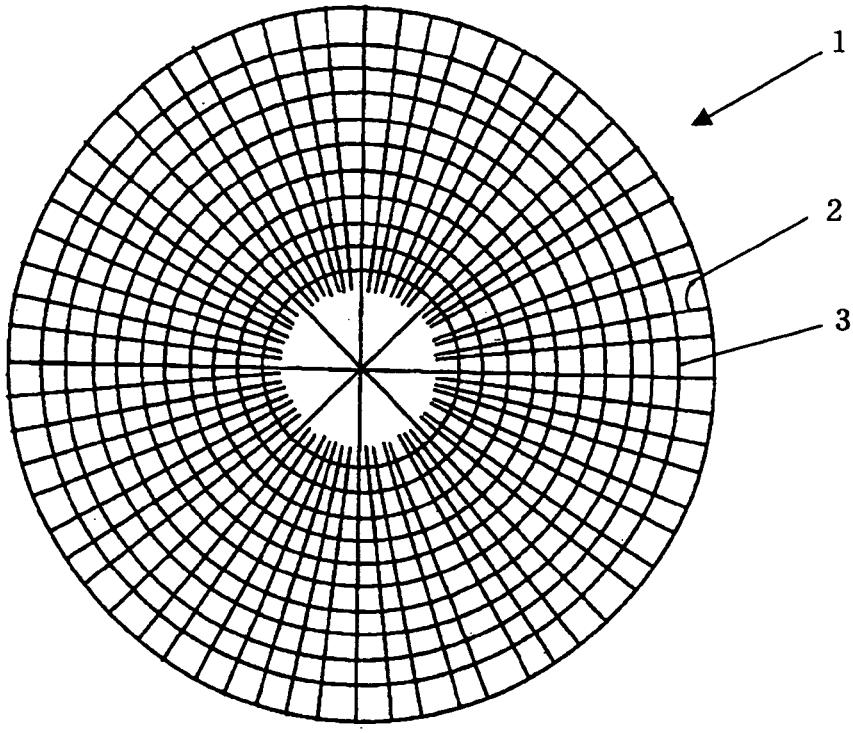
FIG. 3 is a diagram showing still another example of the arrangement of grooves.

In FIG. 3, the pad 1 has a second group of 64 linear grooves 2 and a first group of 10 concentrically circular grooves 3 which differ from one another in diameter. 8 out of the 64 linear grooves start from the center whereas the other 56 linear grooves start from a portion slightly away from the center toward the peripheral portion. In the pad of FIG. 3, all the 64 linear grooves reach the side surface of the pad as well.

Figure 4:
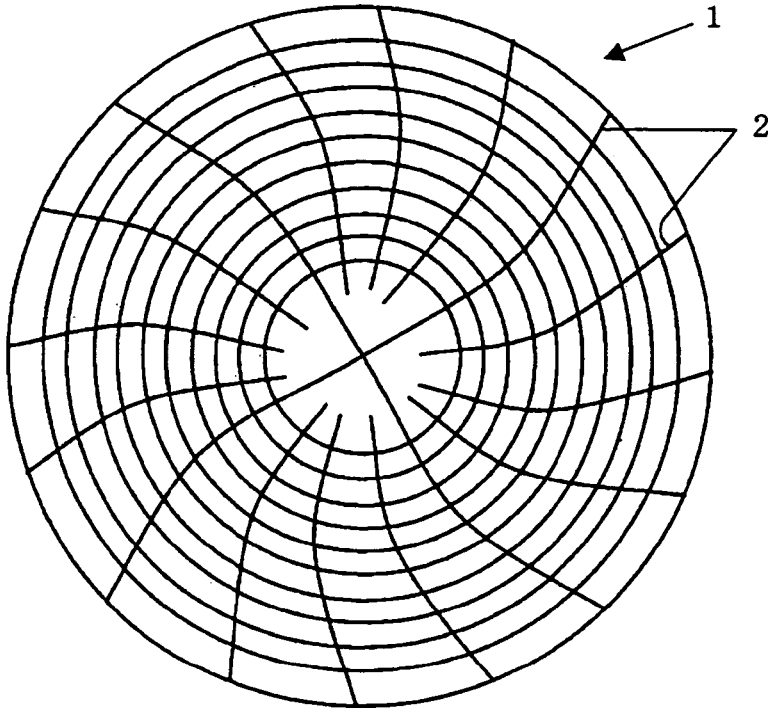
FIG. 4 is a diagram showing a further example of the arrangement of grooves.

In FIG. 4, the pad 1 has a second group of 16 grooves 2 extending from the center portion toward the peripheral portion. 4 out of the 16 grooves start from the center whereas the other 12 grooves start from a portion slightly away from the center toward the peripheral portion. As shown in FIG. 4, the 16 grooves curve to the left halfway from the center toward the periphery but they extend almost linearly excluding these curved portions.

Figure 5:
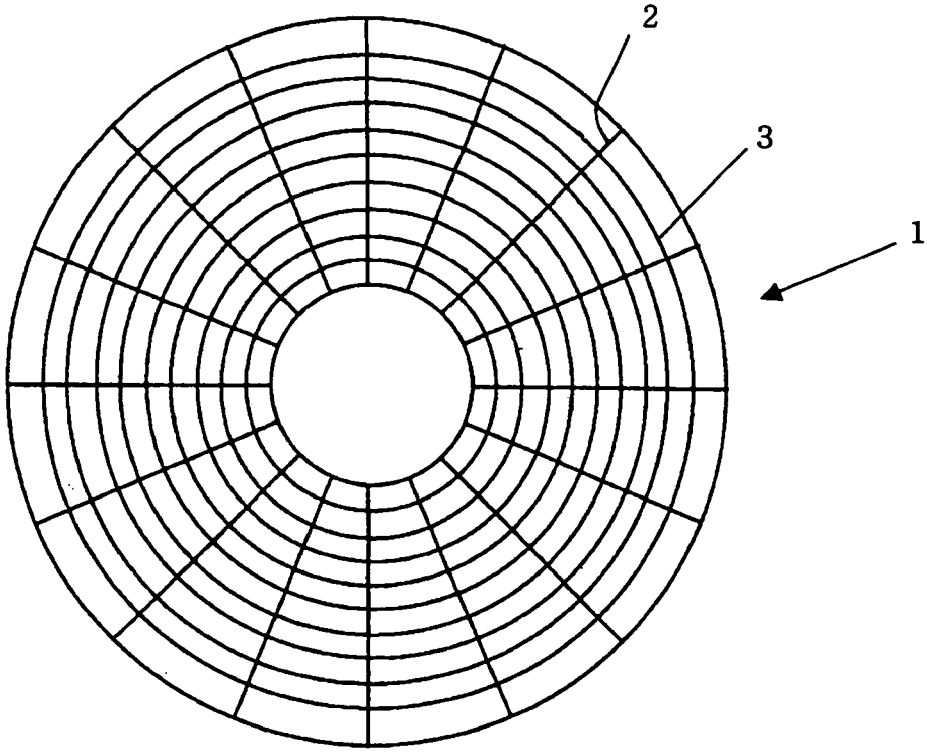
FIG. 5 is a diagram showing a still further example of the arrangement of grooves.

The pad of FIG. 5 is a variation of the pad of FIG. 1. That is, all the 16 linear grooves 2 of the second group start from the center portion, that is, a portion slightly away from the center toward the peripheral portion. All the linear grooves 2 start from their intersections with the smallest circular groove out of the concentrically circular grooves of the first group.

Figure 6:
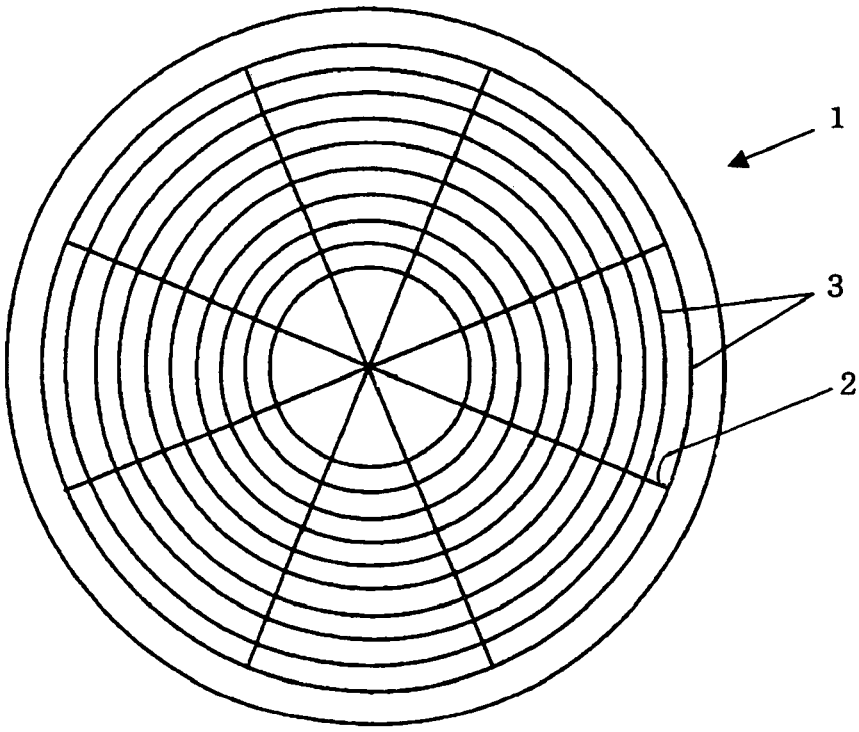
FIG. 6 is a diagram showing a still further example of the arrangement of grooves.

The pad of FIG. 6 has a second group of 8 linear grooves 2 which start from the center. The 8 linear grooves do not reach the side surface of the pad and ends at their intersections with the largest circular groove out of the concentrically circular grooves of the first group.

Figure 7:
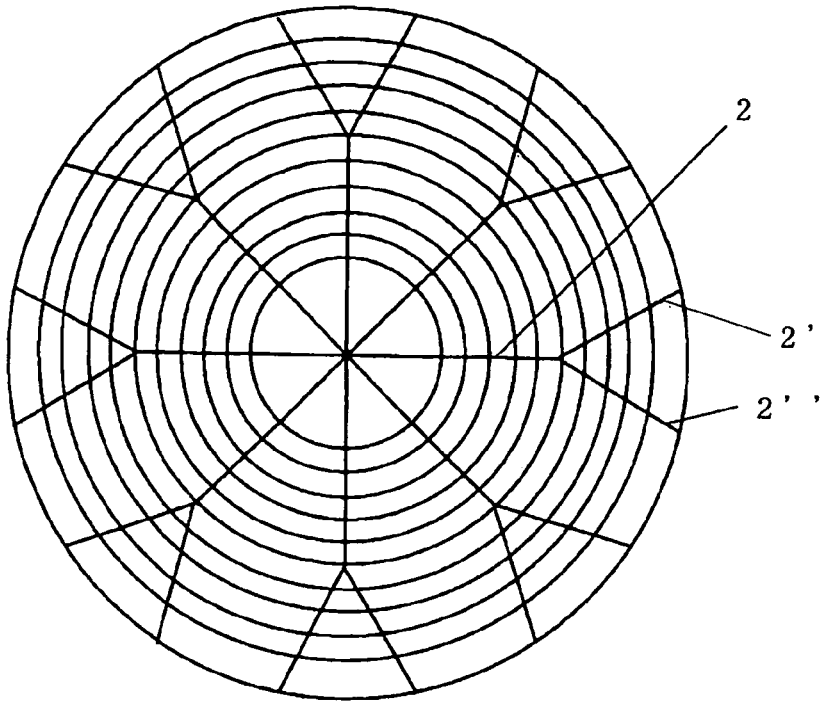
FIG. 7 is a diagram showing a still further example of the arrangement of grooves.

The pad of FIG. 7 has a second group of 8 linear grooves which start from the center and branch into two linear grooves 2' and 2" at a halfway position before they reach the peripheral portion.

Figure 8:
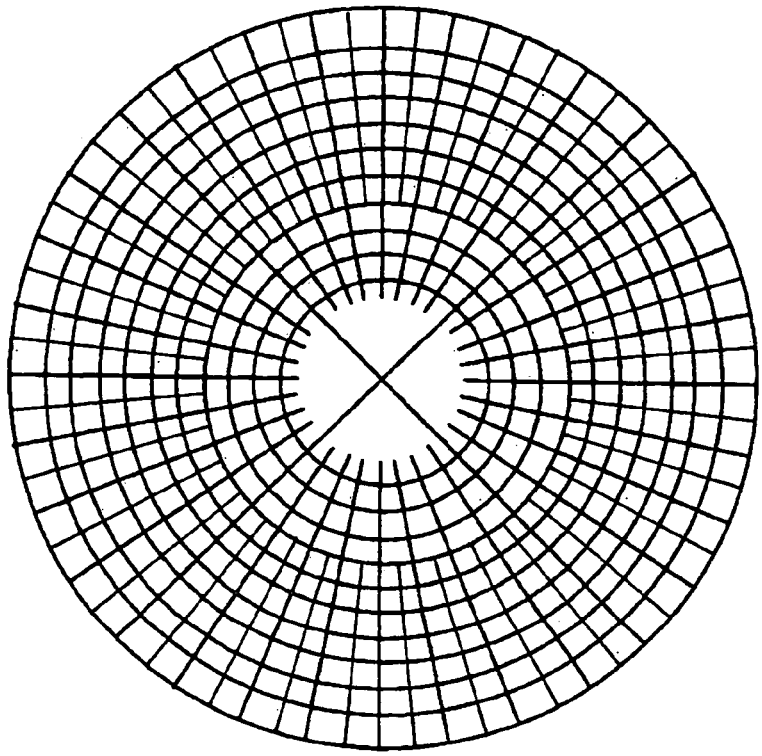
FIG. 8 is a diagram showing a still further example of the arrangement of grooves.

The pad of FIG. 8 has 32 linear grooves, which start from a halfway portion between the center portion and the peripheral portion, between adjacent all of the 32 linear grooves shown in FIG. 2. The 32 linear grooves start from their intersections with the fourth circular groove from the center in FIG. 2.

Figure 9:
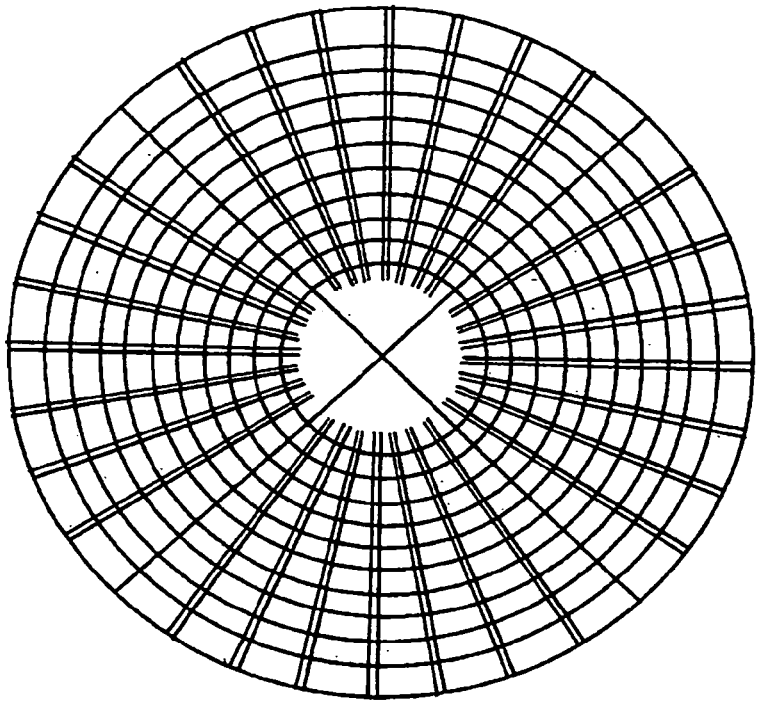
FIG. 9 is a diagram showing a still further example of the arrangement of grooves.

The pad of FIG. 9 has 28 pairs of two parallel linear grooves which start from a portion slightly away from the center toward the peripheral portion in place of the 28 linear grooves in FIG. 2.

Figure 10:
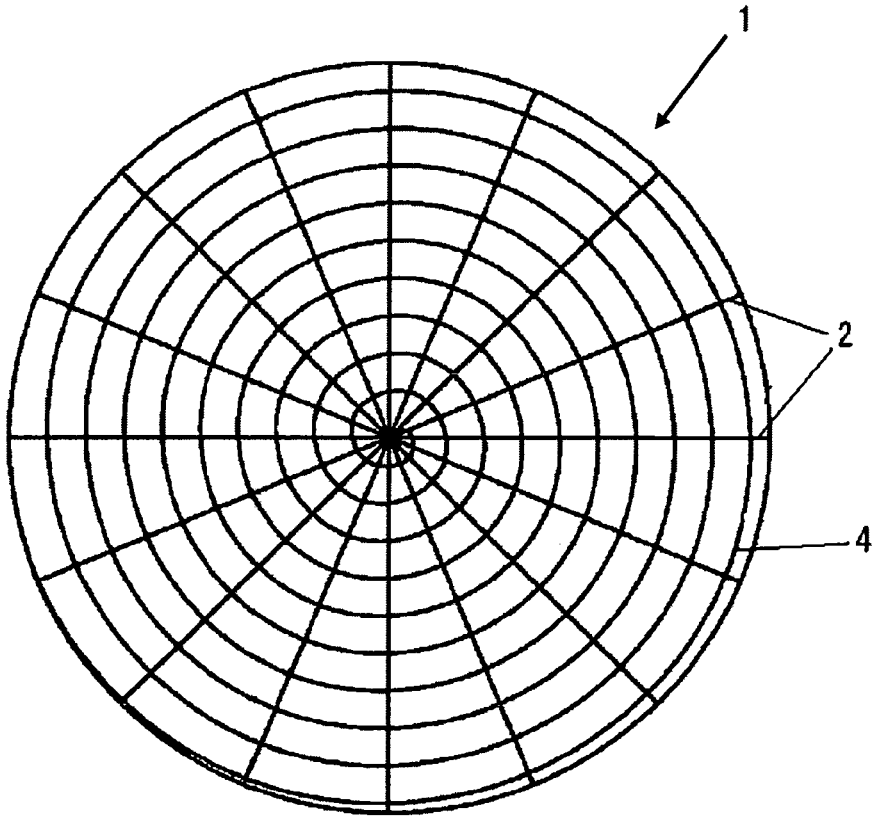
FIG. 10 is a diagram showing a still further example of the arrangement of grooves.

The pad of FIG. 10 has a single first spiral groove 4 which makes 10 turns and a second group of 16 linear grooves 2. The spiral groove starts from the center of the pad, expands gradually and reaches the peripheral portion.

The arrangement of the grooves on the polishing surface of the polishing pad of the present invention is preferably symmetric about the center, for example, point symmetrical, line symmetrical or plane symmetrical as understood from FIGS. 1 to 10. The pad of FIGS. 2, 3, 4, 8 and 9 are most preferably out of the pad of FIGS. 1 to 10. That is, most preferably the total number of the grooves of the second group is 16 to 64, 4 to 8 grooves out of the grooves of the second group are in contact with other grooves of the second group in the area of the center portion of the polishing surface, and 12 to 60 grooves out of the grooves of the second group are not in contact with another groove of the second group.

A method of the present invention comprises either one of a group of steps (A) and a group of steps (B), the group of steps (A) including at least the following steps (A1) to (A5):

(A1) the step of preparing a composition for forming a chemical mechanical polishing pad;

(A2) the step of molding the composition for forming a chemical mechanical polishing pad into a pad-like form;

(A3) the step of mounting the pad-like form on the round table of a cutting machine having at least a milling unit equipped with a milling cutter, a drive unit capable of angle indexing and positioning and a round table journaled by the drive unit;

(A4) the step of forming the second group of grooves with the milling cutter; and (A5) the step of forming the first group of grooves, and the group of steps (B) including at least the following steps (B1) to (B3):

(B1) the step of preparing a composition for forming a chemical mechanical polishing pad;

(B2) the step of molding the composition for forming a chemical mechanical polishing pad into a pad-like form having the second group of grooves by using a metal mold having projections corresponding to the shapes of the second group of grooves; and (B3) the step of forming the first group of grooves.

Each step will be described hereinafter successively.

The Group of Steps (A)

(A1) The Step of Preparing a Composition for Forming a Chemical Mechanical Polishing Pad Compositions for forming a chemical mechanical polishing pad include a composition (may be referred to as "the first composition" hereinafter) comprising (a) at least one selected from a group consists of thermoplastic resins, elastomers, rubbers and curable resins, and (b) water-soluble particles, and a composition (may be referred to as "the second composition" hereinafter) comprising (1) a polyol, (2) a polyisocyanate and (3) a forming agent.

The thermoplastic resins which can be used as a component (a) in the first composition include 1,2-polybutadiene resin, polyolefin resins such as polyethylene, polystyrene resins, polyacrylic resins such as (meth)acrylate-based resins, vinyl ester resins (excluding acrylic resins), polyester resins, polyamide resins, fluororesins such as polyvinylidene fluoride, polycarbonate resins and polyacetal resins.

The above elastomers include diene elastomers such as 1,2-polybutadiene, polyolefin elastomer (TPO), styrene-based elastomers such as styrene-butadiene-styrene block copolymer (SBS) and hydrogenated block copolymers thereof (SEBS), thermoplastic elastomers such as thermoplastic polyurethane elastomers (TPU), thermoplastic polyester elastomers (TPEE) and polyamide elastomers (TPAE), silicone resin elastomers and fluororesin elastomers.

The above rubbers include conjugated diene rubbers such as butadiene rubber (high cis-butadiene rubber, low cis-butadiene rubber, etc.), isoprene rubber, styrene-butadiene rubber and styrene-isoprene rubber, nitrile rubbers such as acrylonitrile-butadiene rubber, acrylic rubber, ethylene-α-olefin rubbers such as ethylene-propylene rubber and ethylene-propylene-diene rubber, and other rubbers such as butyl rubber, silicone rubber and fluorine rubber.

The above curable resins may be a thermo-curable resin or a photo-curable resin, include urethane resins, epoxy resins, acrylic resins, unsaturated polyester resins, polyurethane-urea resins, urea resins, silicon resins, phenolic resins and vinyl ester resins.

These thermoplastic resins may be partially or wholly modified by an acid anhydride group, carboxyl group, hydroxyl group, epoxy group or amino group.

Out of these, rubbers, curable resins, themoplastic resins or elastomers are preferably used, themoplastic resins or elastomers are more preferably used, and 1,2-polybutadiene resin is more preferably used.

The thermoplastic resins may be a partially crosslinked polymer. Chemical crosslinking using an organic peroxide, sulfur or sulfur compound, or radiation crosslinking by applying an electron beam may be employed for crosslinking the above thermoplastic resins.

Examples of the material of the water-soluble particles (b) in the first composition include saccharides (polysaccharides such as starch, dextrin and cyclodextrin, lactose, mannitol, etc.), celluloses (such as hydroxypropyl cellulose, methyl cellulose, etc.), protein, polyvinyl alcohol, polyvinyl pyrrolidone, polyacrylic acid, polyethylene oxide, water-soluble photosensitive resins, sulfonated polyisoprene and sulfonated polyisoprene copolymers. Examples of the material of the inorganic water-soluble particles include potassium acetate, potassium nitrate, potassium carbonate, potassium hydrogencarbonate, potassium chloride, potassium bromide, potassium phosphate and magnesium nitrate. These water-soluble particles may be used alone or in combination of two or more. The water-soluble particles may be made of a predetermined single material, or two or more different materials.

It is preferred that the water-soluble particles should dissolve in water only when they are exposed to the surface layer of the polishing pad and should not absorb moisture or swell when they are existent in the interior of the polishing pad. Therefore, the water-soluble particles may have an outer shell for suppressing moisture absorption on at least part of their outermost portion. This outer shell may be physically adsorbed to the water-soluble particle, chemically bonded to the water-soluble particle, or in contact with the water-soluble particle by physical adsorption and chemical bonding. The outer shell is made of epoxy resin, polyimide, polyamide or polysilicate. Even when it is formed on only part of the water-soluble particle, the above effect can be fully obtained.

The water-soluble particles have an average particle diameter of preferably 0.1 to 500 μm, more preferably 0.5 to 100 μm. The pores are as big as preferably 0.1 to 500 μm, more preferably 0.5 to 100 μm. When the average particle diameter of the water-soluble particles is smaller than 0.1 μm, the formed pores become smaller in size than the abrasive grains in use, whereby a polishing pad capable of holding slurry completely may be hardly obtained. When the average particle diameter is larger than 500 μm, the formed pores become too big, whereby the mechanical strength and polishing rate of the obtained polishing pad may lower.

The amount of the water-soluble particles (b) is preferably 2 to 90 vol %, more preferably 2 to 60 vol %, particularly preferably 2 to 40 vol % based on 100 vol % of the total of the components (a) and the water-soluble particles (b). When the amount of the water-soluble particles (b) is in above range, a high polishing rate and appropriate values of hardness and mechanical strength of the obtained polishing pad are compatible.

Further, when at least some of the components (a) is a crosslinkable polymer, the first composition may contain a crosslinking agent (c). Examples of the crosslinking agent (c) include an organic peroxide, sulfur or sulfur compound. Out of these, an organic peroxide is preferably used. Examples of the organic peroxide include dicumyl peroxide, diethyl peroxide, di-t-butyl peroxide, diacetyl peroxide and diacyl peroxide. The amount of the crosslinking agent is preferably 0.01 to 5.0 parts by mass, more preferably 0.2 to 4.0 parts by mass based on 100 parts by mass of the crosslinkable polymer contained in the component (a). A chemical mechanical polishing pad which suppresses the occurrence of a scratch and has a high polishing rate in the chemical mechanical polishing process can be obtained by setting the amount of the crosslinking agent (c) to the above range.

The polyol (1) in the above second composition is, for example, a polyhydric alcohol, polyether polyol or polyester polyol.

Examples of the above polyhydric alcohol include ethylene glycol, diethylene glycol, propylene glycol, dipropylene glycol, glycerin, trimethylolpropane, diethanolamine, triethanolamine and pentaerythritol.

Preferably, the above polyester polyol can be manufactured through a reaction between a polycarboxylic acid or a derivative thereof and a polyhydroxyl compound.

The polyisocyanate (2) is, for example, 2,4-toluylene diisocyanate, 2,6-toluylene diisocyanate and polyphenylpolymethylene polyisocyanate. Some or all of these polyisocyanates may have a carboimide, urethane or isocyanurate group.

The amount of the polyisocyanate (2) is preferably 0.9 to 1.4 equivalents, more preferably 0.95 to 1.3 equivalents in terms of isocyanate based on 1 equivalent of the hydroxyl group of the polyol (1).

The foaming agent (3) is water or freon. The amount of the foaming agent (3) is preferably 4 to 10 parts by mass based on 100 parts by mass of the polyol (1).

The second composition may contain (4) a catalyst besides the above components. The catalyst (4) is, for example, an amine compound or an organic metal compound. Examples of the amine compound include triethylenediamine, triethylamine, tetramethylhexamethylenediamine, pentamethyldiethylenetriamine and dimethylcyclohexylamine. Examples of the organic metal compound include stannous chloride and dibutyltin laurate. The amount of the catalyst (4) is preferably 1 part by mass or less, more preferably 0.05 to 1 part by mass, much more preferably 0.05 to 0.5 part by mass based on 100 parts by mass of the polyol (1).

The second composition may further contain a foam stabilizer, other resin, flame retardant and surfactant besides the above components.

The method of preparing the above composition for forming a chemical mechanical polishing pad is not particularly limited. For example, it can be obtained by kneading together predetermined materials with a kneader. Examples of the kneader include a roll, kneader, Banbury mixer and extruder (single-screw or multi-screw).

When the composition for forming a chemical mechanical polishing pad is the first composition, the water-soluble particles (b) are preferably solid at the time of kneading. When the water-soluble particles (b) are solid at the time of kneading, the water-soluble particles (b) can be dispersed at a preferred average particle diameter as described above regardless of compatibility between the components (a) and (b). Therefore, water-soluble particles (b) having a higher melting point than the processing temperature is preferably selected according to the processing temperature of the component (a).

(A2) Step of Molding Composition for Forming a Chemical Mechanical Polishing Pad into a Pad-like Form To mold the above composition for forming a chemical mechanical polishing pad into a pad-like form, various methods may be employed: one in which a metal mold having a shape corresponding to a desired pad-like form is used to mold the composition; and one in which the composition for forming a chemical mechanical polishing pad is molded into a sheet form and this sheet is punched into a desired pad-like form.

(A3) step of mounting the above pad-like form on the round table of a cutting machine having a milling unit provided with a milling cutter, a drive unit capable of angle indexing and positioning and a round table journaled by the drive unit.

Figure 11:
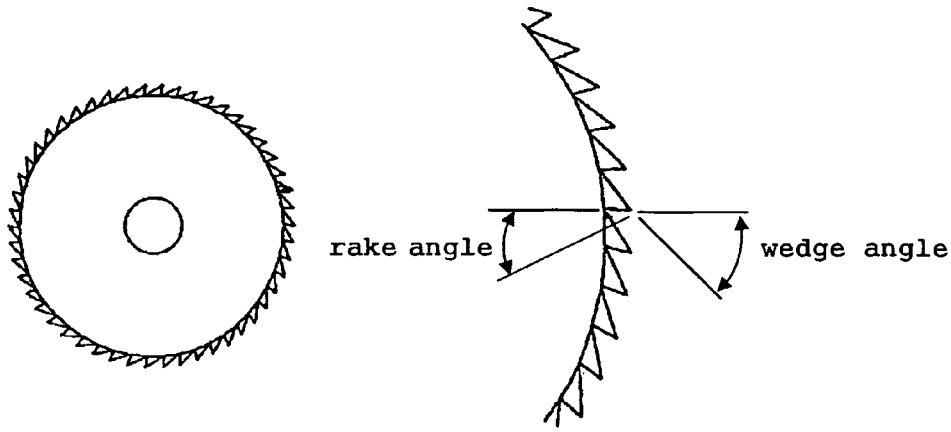
FIG. 11 is a diagram showing a milling cutter.

The above milling cutter is a rotary blade unit having a large number of cutting teeth at the periphery of a disk-like substrate. The rake angle of each cutting tooth is preferably −20 to 40°, more preferably −5 to 20°. The width of tooth is preferably 0.2 to 10 mm, more preferably 0.3 to 3.0 mm. The width of tooth is selected by the desired width of the grooves of the second group. The wedge angle is preferably 20 to 110°, more preferably 40 to 70°. FIG. 11 shows an example of the milling cutter. In FIG. 11, the rake angle is shown as the angle between the rake face of the cutting tooth and a virtual straight line extending to the center of the milling cutter.

The above milling cutter is attached to the milling unit to be used. The number of milling cutters attached to the milling unit is selected by the shape of the grooves of the second group to be formed. When the grooves of the second group to be formed by cutting are independent grooves as shown in FIGS. 1 to 8 and 10, one milling cutter is attached to the milling unit and when the grooves of the second group are paired as shown in FIG. 9, two milling cutters are attached to the milling unit to process of cutting the pad advantageously.

Since the milling unit can move in X, Y and Z directions with respect to the surface of the pad on the round table mounting the pad-like form, cutting with the milling cutter can be carried out smoothly.

The drive unit capable of angle indexing and positioning has a servo motor, a decelerator and a belt and is journaled by the round table which performs angle indexing. The rotation angle of the round table can be indexed by the servo motor, decelerator and belt.

The above round table is journaled by the drive unit as described above. The round table has a large number of holes communicating with a negative pressure generator, and the pad-like form is suction held on the surface of the table by negative pressure through the holes. For example, the arrangement of the large number of holes formed in the round table is determined by the size of the pad-like form so that suction adsorption can be carried out properly.

(A4) The step of forming the above grooves of the second group with the milling cutter is carried out by forming the grooves of the second group by cutting one by one while the angle is indexed according to the constitution of the grooves of the second group as described in the above step (A3).

(A5) The step of forming the grooves of the first group can be carried out by using a known cutting machine.

The step (A5) may be carried out after the steps (A3) and (A4) or before the steps (A3) and (A4).

Steps (B)

(B1) Step of Preparing Composition for Forming a Chemical Mechanical Polishing Pad The composition for forming a chemical mechanical polishing pad in the step (B1) is the same as in the above step (A1).

Figure 12:
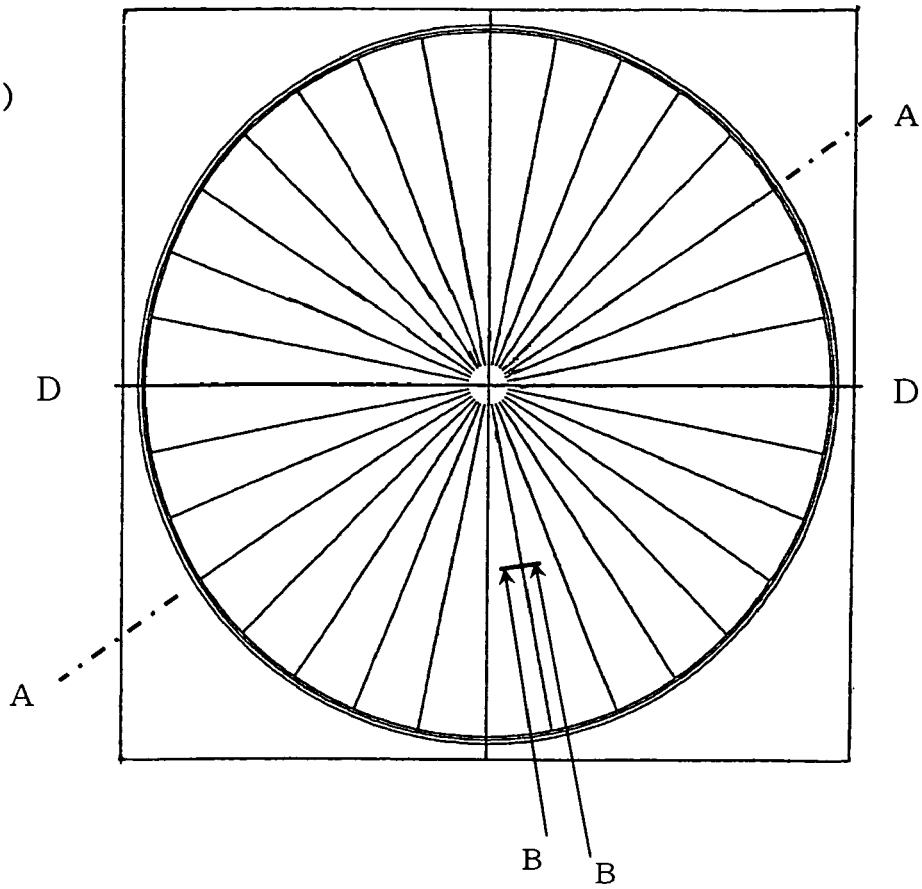
FIG. 12 is a diagram of a mold (a lower mold) for forming a polishing surface of a chemical mechanical polishing pad of the present invention.
Figure 12:
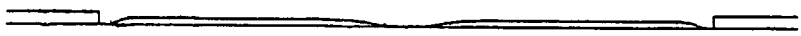
Figure 12:
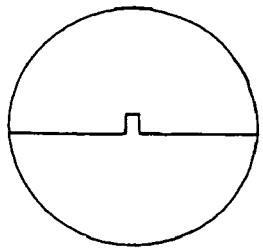
Figure 12:
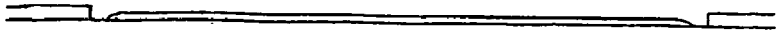

(B2) step of molding the composition for forming a chemical mechanical polishing pad into a pad-like form having the grooves of the second group by using a metal mold having projections corresponding to the shapes of the grooves of the second group FIGS. 12(*a*) to 12(*d*) are schematic diagrams of a lower mold for forming the polishing surface side of the chemical mechanical polishing pad. FIG. 12(*a*) is a plane view, FIG. 12(*b*) is a sectional view along the line A-A, FIG. 12(*c*) is a sectional view along the line B-B and FIG. 12(*d*) is a sectional view along the line D-D. FIGS. 12(*a*) to 12(*d*) show projections corresponding to the grooves of the second group. FIG. 12(*c*) shows a projection having a rectangular section, and FIGS. 12(*b*) and 12(*d*) show that the end portions of the projection (center and peripheral portions of the pad) are "rounded-shape". The shape, size, number and arrangement of the projections are understood from the above-described sectional form, size, number and arrangement of the grooves of the second group of the pad. The shape of the end portions of the projection may be such that the height of the end portion decreases linearly (like an oblique side of a triangle) or the end portion is vertical besides the illustrated "rounded-shape".

The lower mold of FIGS. 12(*a*) to 12(*d*) is combined with a upper mold (not shown in the figures) for molding the non-polishing surface side of the pad, and the composition for forming a chemical mechanical polishing pad is injected into the cavity in the formed mold and heated to form a pad-like form having the grooves of the second group.

(B3) Step of Forming Grooves of First Group

The step of forming the grooves of the first group can be carried out by using a known cutting machine.

The chemical mechanical polishing pad manufactured by the above-described method of the present invention can provide an excellent polished surface at a high polishing rate and has a long service life.

The mechanism that the chemical mechanical polishing pad manufactured by the method of the present invention reduces the number of scratches on the polished surface of an object is not made clear yet. Since a phenomenon that an aqueous dispersion for chemical mechanical polishing and polishing chips are remained in the center portion of the conventionally known chemical mechanical polishing pad is observed in the chemical mechanical polishing process, it is assumed that the above holdup serves as the source of a scratch. Meanwhile, since the above phenomenon is not observed in the chemical mechanical polishing step when the chemical mechanical polishing pad manufactured by the method of the present invention is used, it is considered that the remains are effectively removed by the formation of the above grooves in the polishing surface, thereby obtaining the effect of reducing the number of scratches.

The chemical mechanical polishing pad manufactured by the above-described method can be used for chemical mechanical polishing by means of known processes when it is set in a commercially available polishing machine.

The type of the surface to be polished and the type of the aqueous dispersion for chemical mechanical polishing in use are not particularly limited.

The chemical mechanical polishing pad may be used for chemical mechanical polishing process as a multi-layer polishing pad having a base layer formed on the non-polishing surface of the pad. The above "base layer" is a layer formed on the rear surface to support the chemical mechanical polishing pad. Although the characteristic properties of this base layer are not particularly limited, the base layer is preferably softer than the pad body (polishing layer). When the pad has a softer base layer than the pad body, if the pad body is thin, for example, 1.0 mm or less, it is possible to prevent the pad body from rising during polishing or the surface of the polishing layer from curving, whereby polishing can be carried out stably. The hardness of the base layer is preferably 90% or less, more preferably 50 to 90%, much more preferably 50 to 80%, particularly preferably 50 to 70% of the hardness of the pad body.

The base layer may be made of a porous material such as foam or a non-porous material. The planar shape of the base layer is not particularly limited and may be circular or polygonal, for example, tetragonal. Preferably, the planer shape of the base layer may be the same with that of the pad body. Its thickness is not particularly limited but preferably 0.1 to 5 mm, more preferably 0.5 to 2 mm.

As stated above, the method of manufacturing a chemical mechanical polishing pad of the present invention provides a chemical mechanical polishing pad which fully suppresses the occurrence of a scratch on the polished surface and has an excellent polishing rate.

EXAMPLES

Example 1

(1) Manufacture of Chemical Mechanical Polishing Pad 80 parts by volume (equivalent to 72 parts by mass) of 1,2-polybutadiene (manufactured by JSR Corporation, trade name of JSR RB830) and 20 parts by volume (equivalent to 28 parts by mass) of β-cyclodextrin (manufactured by Bio Research Corporation of Yokohama, trade name of Dexy Pearl β-100, average particle diameter of 20 μm) as water-soluble particles were kneaded together by an extruder set at 160° C. 1.0 part by volume (equivalent to 0.44 parts by mass of pure dicumyl peroxide) of Percumyl D40 (trade name, manufactured by NOF Corporation, containing 40 mass % of dicumyl peroxide) as dicumyl peroxide was added to and kneaded with the above kneaded product at 120° C. to obtain a pellet of a composition for forming a chemical mechanical polishing pad. This pellet was fed to the inside of a mold and heated at 170° C. for 18 minutes to be crosslinked so as to obtain a disk-like molded product having a diameter of 600 mm and a thickness of 2.5 mm (pad-like form).

Concentrically circular grooves having a width of 0.5 mm and a depth of 1.0 mm were formed in the polishing surface of this molded product at a pitch of 2.0 mm by using a cutting machine manufactured by Kato Machinery Co., Ltd. (first group of grooves). Further, 16 linear grooves (having a width of 1.0 mm and a depth of 1.0 mm) extending from the center to the peripheral end of the pad were formed in the polishing surface by a cutting machine equipped with a drive unit capable of angle indexing and positioning in such a manner that they were in contact with one another at the center of the polishing surface of the pad and the angle between adjacent linear grooves was 22.5° (second group of grooves) to manufacture a chemical mechanical polishing pad. One milling cutter having a diameter of 125 mm and 70 teeth was used. The rake angle of each tooth of the milling cutter was 30°, the wedge angle was 70°, the width of tooth was 1.0 mm and the angle of the side cutting tooth was −7°. The arrangement of the formed grooves corresponds to the diagram shown in FIG. 1. When the surface roughness of the inner wall of each of the formed grooves was measured with a 3-D surface configuration analyzing microscope (Zygo New View 5032 of Canon Inc.), the surface roughness of the grooves of the first and second groups were 4.2 μm.

(2) Evaluation of Polishing Rate and the Number of Scratches

The above manufactured chemical mechanical polishing pad was set on the platen of a polishing machine (EPO112 of Ebara Corporation), and a wafer (diameter of 8 inches) having a plain $SiO_2$ film (PETEOS film: $SiO_2$ film formed from tetraethyl orthosilicate (TEOS) by chemical vapor deposition using plasma as a promoting condition) was polished by using the CMS-1101 (trade name, manufactured by JSR Corporation) diluted 3 times as chemical mechanical polishing slurry under the following conditions to evaluate the polishing rate and the number of scratches. As a result, the polishing rate was 210 nm/min and no scratch was observed on the polished surface.

Platen revolution: 70 rpm
Head revolution: 63 rpm
Head pressure: 4 psi
Slurry feed rate: 200 ml/min
Polishing time: 2 minutes The above polishing rate was calculated from the difference in film thickness by measuring the thickness of the film before and after polishing with an optical film thickness meter. The number of scratches on the entire polished surface of the $SiO_2$ film wafer after polishing was counted with a wafer defect inspection device (KLA2351 of KLA-Tencor Co., Ltd.).

Example 2

28.2 parts by mass of polytetramethylene glycol having two hydroxyl groups at both terminals of the molecule and a number average molecular weight of 650 (manufactured by Mitsubishi Chemical Co., Ltd., trade name of PTMG650) and 21.7 parts by mass of 4,4'-diphenylmethane diisocyanate (manufactured by Sumika Bayer Urethane Co., Ltd., trade name of Sumidule 44S) were fed to a reactor and maintained at 90° C. for 3 hours under agitation to carry out a reaction, and then cooled to obtain a prepolymer having an isocyanate group at both terminals.

14.5 parts by mass of β-cyclodextrin (manufactured by Bio Research Corporation of Yokohama, trade name of Dexy Pearl β-100, average particle diameter of 20 μm) as water-soluble particles was dispersed into 21.6 parts by mass of polypropylene glycol having three hydroxyl groups and a number average molecular weight of 330 (manufactured by NOF Corporation, trade name of Uniol TG300, addition reaction product of glycerin and propylene oxide) and 6.9 parts by mass of the PTMG650 polytetramethylene glycol as crosslinking agents by agitation, and further 0.1 part by mass of 2-methyl triethylenediamine (manufactured by Sankyo Air Products Co., Ltd., trade name of Me-DABCO) was dissolved in the obtained dispersion as a reaction accelerator by agitation. The resulting mixture was added to the reactor of the above prepolymer having an isocyanate group at both terminals.

Further, 21.6 parts by mass of the Sumidule 44S 4,4'-diphenylmethane diisocyanate was added to the above reactor of the prepolymer having an isocyanate group at both terminals, stirred at 200 rpm at room temperature for 2 minutes and defoamed under reduced pressure to obtain a composition for forming a chemical mechanical polishing pad.

This composition for forming a chemical mechanical polishing pad was injected into a metal mold having a diameter of 60 cm and a thickness of 3 mm and maintained at 80° C. for 20 minutes to carry out the polymerization of polyurethane and further post-cured at 110° C. for 5 hours to obtain a molded product (a pad-like form) having a diameter of 600 mm and a thickness of 2.5 mm.

Thereafter, grooves of the first and second groups were formed on the molded product in the same manner as in Example 1 to obtain a chemical mechanical polishing pad. The surface roughness of the inner wall of each of the formed grooves of the first and second groups were 3.0 μm.

The polishing rate and the number of scratches were evaluated in the same manner as in Example 1 except that the above polishing pad was used. As a result, the polishing rate was 231 nm/min and no scratch was observed.

Example 3

After the grooves of the first group were formed in the pad-like form in Example 1, four linear grooves (having a width of 1.0 mm and a depth of 1.0 mm) extending from the center to the peripheral end of the pad were formed as grooves of the second group by a cutting machine equipped with a drive unit capable of angle indexing and positioning in such a manner that they were in contact with one another at the center of the polishing surface of the pad and the angle between adjacent linear grooves was 90°. The four grooves correspond to the four grooves of the second group in contact with one another at the center in FIG. 9. One milling cutter was used to form the four grooves. Further, 28 pairs of linear grooves (the pitch between grooves was 2 mm) extending from points 25 mm away from the center of the pad to the peripheral end of the pad were formed by the same cutting machine as above in such a manner that the angle between adjacent linear grooves was 11.25°. The 28 pairs of grooves correspond to the 28 pairs of grooves shown in FIG. 9. Two milling cutters were used to form these paired grooves at a pitch (distance between the centers of the blades) of 2 mm.

The grooves were formed as described above to manufacture a chemical mechanical polishing pad. Since paired linear grooves having a pitch of 2 mm were formed from the center portion to the peripheral portion of the pad at the same pitch of 2 mm, it is understood that they slightly shifted from the diameter direction of the pad though they started from the center portion of the pad.

The grooves formed herein correspond to those shown in FIG. 9. The surface roughnesses of the inner walls of each of the grooves of the first group and each of the grooves of the second group were 2.7 μm. The polishing rate and the number of scratches were evaluated in the same manner as in Example 1 except that the chemical mechanical pad manufactured herein was used. As a result, the polishing rate was 233 nm/min and no scratch was observed.

Example 4

56 parts by volume (equivalent to 48 parts by mass) of 1,2-polybutadiene (manufactured by JSR Corporation, trade name of JSR RB830), 14 parts by volume (equivalent to 12 parts by mass) of polystyrene (manufactured by E and Enstylene, trade name of GPPS HF55) and 30 parts by volume (equivalent to 40 parts by mass) of β-cyclodextrin (manufactured by Bio Research Corporation of Yokohama, trade name of Dexy Pearl β-100, average particle diameter of 20 μm) as water-soluble particles were kneaded together by an extruder set at 160° C. Thereafter, 0.5 part by volume (equivalent to 0.56 part by mass) of dicumyl peroxide (manufactured by NOF Corporation, trade name of Percumyl D) was added to and kneaded with the above kneaded product at 120° C. to obtain a pellet of a composition for forming a chemical mechanical polishing pad. This pellet was heated in a mold having projections corresponding to the grooves of the second group and shown in FIG. 12(*a*) (plan view) at 180° C. for 10 minutes to be crosslinked so as to obtain a disk-like molded product having a diameter of 600 mm and a thickness of 2.8 mm. This molded product had 4 linear grooves (they had a width of 1.0 mm and a depth of 1.4 mm and were in contact with one another at the center of the surface, and the angle between adjacent linear grooves was 90°) extending from the center to the peripheral end of the surface and 28 linear grooves (they had a width of 1.0 mm and a depth of 1.4 mm, and the angle between adjacent linear grooves was 11.25°) extending from points 25 mm away from the center to the peripheral end of the surface, on one surface (polishing surface) of the disk as grooves of the second group.

Concentrically circular grooves (grooves of the first group) having a width of 0.5 mm, a pitch of 2.0 mm and a depth of 1.4 mm were formed in the polishing surface of this molded product having the grooves of the second group by using a cutting machine manufactured by Kato Machinery Co., Ltd. to manufacture a chemical mechanical polishing pad. The grooves of this pad correspond to the diagram shown in FIG. 2. The surface roughness of the inner wall of each of the grooves formed herein was 3.5 μm.

The polishing rate and the number of scratches were evaluated in the same manner as in Example 1 except that the chemical mechanical polishing pad manufactured herein was used. As a result, the polishing rate was 210 nm/min and the number of scratches was 1.

Example 5

A disk-like molded product (pad-like form) as large as that of Example 1 was produced in the same manner as in Example 1. Concentrically circular grooves having a width of 0.5 mm and a depth of 1.0 mm were formed in the polishing surface of this molded product at a pitch of 1.5 mm by using a cutting machine manufactured by Kato Machinery Co., Ltd.

(First Group of Grooves).

Thereafter, grooves of the second group were formed in the same manner as in Example 3 to obtain a chemical mechanical polishing pad. The surface roughness of the inner wall of each of the formed grooves of the first and second groups were 2.7 μm.

The polishing rate and the number of scratches were evaluated in the same manner as in Example 1 except that the above polishing pad was used. As a result, the polishing rate was 233 nm/min and no scratch was observed.

Example 6

A disk-like molded product (pad-like form) as large as that of Example 1 was produced in the same manner as in Example 1. Concentrically circular grooves having a width of 0.5 mm and a depth of 1.0 mm were formed in the polishing surface of this molded product at a pitch of 4.0 mm by using a cutting machine manufactured by Kato Machinery Co., Ltd.

(First Group of Grooves).

Thereafter, four linear grooves (having a width of 1.0 mm and a depth of 1.0 mm) extending from the center to the peripheral end of the pad were formed as grooves of the second group by a cutting machine equipped with a drive unit capable of angle indexing and positioning in such a manner that they were in contact with one another at the center of the polishing surface of the pad and had the angle between adjacent linear grooves was 90°. In this case, one milling cutter was used to form the four grooves. Further, 12 pairs of linear grooves (the pitch between grooves was 2 mm) extending from points 25 mm away from the center of the pad to the peripheral end of the pad were formed by the same cutting machine as above in such a manner that the angle between adjacent linear grooves was 22.5°. Two milling cutters having a pitch of distance between the centers of the blades of 2 mm were used to form these paired grooves. The surface roughnesses of the inner walls of each of the grooves of the first group and each of the grooves of the second group were 2.7 μm.

The polishing rate and the number of scratches were evaluated in the same manner as in Example 1 except that the above polishing pad was used. As a result, the polishing rate was 233 nm/min and no scratch was observed.

Comparative Example 1

A disk-like molded product (pad-like form) as large as that of Example 1 was produced in the same manner as in Example 1 in order to manufacture a chemical mechanical polishing pad in the same manner as in Example 1 except that only concentrically circular grooves (grooves of the first group) having a width of 0.5 mm, a pitch of 2.0 mm and a depth of 1.0 mm were formed in the polishing surface by using a cutting machine manufactured by Kato Machinery Co., Ltd., and the grooves of the second group were not formed. The surface roughness of the inner wall of each of the grooves formed herein was 4.8 μm.

The polishing rate and the existence of scratches were evaluated in the same manner as in Example 1 except that this polishing pad was used. As a result, the polishing rate was 200 nm/min and 15 scratches were seen.

Comparative Example 2

A disk-like molded product (pad-like form) as large as that of Example 1 was produced in the same manner as in Example 1 in order to manufacture a chemical mechanical polishing pad in the same manner as in Example 1 except that concentrically circular grooves of the first group were not formed and only grooves of the second group were formed in the polishing surface. The surface roughness of the inner wall of each of the formed grooves was 4.5 μm.

The polishing rate and the existence of scratches were evaluated in the same manner as in Example 1 except that this polishing pad was used. As a result, the polishing rate was 120 nm/min and 25 scratches were seen.

Comparative Example 3

A chemical mechanical polishing pad was manufactured in the same manner as in Example 1 except that a disk-like molded product as large as that of Example 1 was manufactured and lattice-like grooves having a width of 1.0 mm, a pitch of 10.0 mm and a depth of 1.0 mm were formed. The surface roughness of the inner wall of each of the grooves herein formed was 5.5 μm.

As for the formation of the above grooves, 10 milling cutters having a pitch of 10 mm were attached to the same cutting machine as that used to form the grooves of the second group in Examples, parallel grooves were formed in one direction while the milling unit was moved relative to the surface of the pad, the pad was turned at 90°, and then parallel grooves perpendicular to the above grooves were formed likewise while the milling unit was moved relative to the surface of the pad.

The polishing rate and the existence of scratches were evaluated by using this polishing pad in the same manner as in Example 1. As a result, the polishing rate was 150 nm/min and the number of scratches was 50.

What is claimed is:

1. A chemical mechanical polishing pad having a polishing surface, a non-polishing surface opposite to the polishing surface and a side surface for defining these surfaces, the polishing surface having at least two groups of grooves, wherein the two groups of grooves consist of (i) a f first group of grooves which intersect a single virtual straight line extending from the center portion toward the peripheral portion of the polishing surface and do not cross one another and (ii) a second group of grooves which extend f from the center portion toward the peripheral portion of the polishing surface, intersect the first group of grooves and do not cross one another, and the grooves of the second group consist of grooves extending from the center portion which is an area surrounded by a circle having a radius of 50 mm from the center of gravity on the polishing surface toward the peripheral portion and not in contact with another groove of the second group in the area of the center portion, and grooves extending from the center portion toward the peripheral portion and in contact with other grooves of the second group in the area of the center portion.

2. A chemical mechanical polishing pad according to claim 1, wherein 2 to 33 grooves out of grooves extending from the center portion are not in contact with another groove of the second group in the area of the center portion, and 2 to 32 grooves out of grooves extending from the center portion are in contact with another groove of the second group in the area of the center portion.

3. A chemical mechanical polishing pad having a polishing surface, a non-polishing surface opposite to the polishing surface and a side surface for defining these surfaces, the polishing surface having at least two groups of grooves, wherein the two groups of grooves consist of (i) a single first spiral groove which expands gradually from the center portion toward the peripheral portion of the polishing surface and (ii) a second group of grooves which extend from the center portion toward the peripheral portion of the polishing surface, intersect the first group of grooves and do not cross one another, and the grooves of the second group consist of grooves extending from the center portion which is an area surrounded by a circle having a radius of 50 mm from the center of gravity on the polishing surface toward the peripheral portion and not in contact with another groove of the second group in the area of the center portion, and grooves extending from the center portion toward the peripheral portion and in contact with other grooves of the second group in the area of the center portion.

4. A chemical mechanical polishing pad according to claim 3, wherein 2 to 33 grooves out of grooves extending from the center portion are not in contact with another groove of the second group in the area of the center portion, and 2 to 32 grooves out of grooves extending from the center portion are in contact with another groove of the second group in the area of the center portion.

* * * * *